US010092116B1

(12) United States Patent
Johns et al.

(10) Patent No.: US 10,092,116 B1
(45) Date of Patent: Oct. 9, 2018

(54) JEWELRY DISPLAY CASE

(71) Applicant: SPARKLE LIFE, Gainesville, FL (US)

(72) Inventors: Jeremiah Johns, Gainesville, FL (US); Jena Anderson, Gainesville, FL (US)

(73) Assignee: SPARKLE LIFE, Gainesville, FL (US)

( * ) Notice: Subject to any disclaimer, the term of this patent is extended or adjusted under 35 U.S.C. 154(b) by 0 days.

(21) Appl. No.: 15/814,983

(22) Filed: Nov. 16, 2017

(51) Int. Cl.
*A47F 7/02* (2006.01)
*A47F 7/024* (2006.01)
*E05B 73/00* (2006.01)

(52) U.S. Cl.
CPC ..... *A47F 7/022* (2013.01); *A47F 7/024* (2013.01); *E05B 73/00* (2013.01)

(58) Field of Classification Search
USPC ..... 211/85.2, 4, 7–9; 206/6.1, 806, 1.5; 70/58–62
See application file for complete search history.

(56) References Cited

U.S. PATENT DOCUMENTS 438,735 A * 10/1890 Miller ..... A63C 11/025 211/4
531,496 A * 12/1894 Barwick ..... B42D 5/005 211/7
839,298 A * 12/1906 Kitterman ..... A45F 5/10 211/4
858,993 A * 7/1907 Kostolnik ..... E05B 69/006 211/8
862,505 A * 8/1907 Perrin ..... E05B 69/006 211/8
1,652,233 A * 12/1927 Branick ..... E05B 67/383 70/15
2,037,971 A * 4/1936 Ferren ..... E05B 73/00 70/61
2,046,815 A * 7/1936 Fike ..... E05B 73/00 70/61
2,119,217 A * 5/1938 Rocchi ..... B25B 13/56 206/376
2,593,049 A * 4/1952 Paul ..... A47F 7/19 211/8
2,953,251 A * 9/1960 Stone ..... A47J 47/16 211/4
2,995,025 A * 8/1961 Toepfer ..... E05B 19/0005 206/216
3,283,914 A * 11/1966 Robinson ..... B65G 9/002 211/1.57
3,419,154 A * 12/1968 Shapiro ..... A47F 7/24 211/124
3,472,385 A * 10/1969 Parillo ..... A47F 7/24 211/124
3,567,034 A * 3/1971 Mozelsio ..... A47G 25/0692 211/7
3,690,130 A * 9/1972 Eutzler ..... E05B 69/006 211/4

(Continued)

*Primary Examiner* — Jonathan Liu
*Assistant Examiner* — Devin K Barnett
(74) *Attorney, Agent, or Firm* — Millen, White, Zelano & Branigan, P.C.

(57) ABSTRACT

The invention of the current application is directed to a jewelry display device which securely displays jewelry at optionally varying heights in such a way that the jewelry optionally face outward when the hold bar is positioned horizontal to the eye line of the customer and also optionally prevent theft while optionally still allowing the customer to handle and interact with the jewelry.

4 Claims, 6 Drawing Sheets

(56) References Cited

U.S. PATENT DOCUMENTS 4,045,897 A * 9/1977 Gates ..... G09F 7/12 40/620
4,057,983 A * 11/1977 Morgan ..... A63C 11/006 24/327
4,204,601 A * 5/1980 Thomas ..... A47F 7/024 211/124
4,212,175 A * 7/1980 Zakow ..... E05B 73/0005 70/58
4,265,039 A * 5/1981 Brooks ..... G09F 13/04 160/395
4,300,690 A * 11/1981 Thomas ..... A47F 7/024 211/124
4,336,885 A * 6/1982 Thomas ..... A47F 7/024 211/4
4,406,372 A * 9/1983 Bell ..... A47F 7/024 206/493
4,420,084 A * 12/1983 Whelan ..... A47F 7/02 206/486
4,474,116 A * 10/1984 Castenada, Jr. ..... A45C 13/20 109/50
4,615,447 A * 10/1986 Walter ..... A47F 7/24 211/4
4,776,650 A * 10/1988 Ferenzi ..... A47B 67/02 211/85.2
4,784,314 A * 11/1988 Penick ..... B65D 5/4258 206/457
4,811,853 A * 3/1989 Mead ..... B65D 85/185 206/279
4,852,284 A * 8/1989 Faggiano ..... G09F 7/00 40/488
4,940,147 A * 7/1990 Hunt ..... A47F 5/0807 211/40
5,016,758 A * 5/1991 Ward ..... A47F 7/24 211/4
5,067,617 A * 11/1991 Caldwell ..... A47F 5/0807 206/495
5,103,984 A * 4/1992 Leyden ..... A47F 5/0861 211/4
5,154,072 A * 10/1992 Leyden ..... E05B 69/006 211/4
5,160,048 A * 11/1992 Leyden ..... A47F 7/24 211/7
5,428,914 A * 7/1995 Whitehouse ..... G09F 7/06 40/594
5,462,177 A * 10/1995 O'Donnell ..... A47B 81/068 211/40
5,493,879 A * 2/1996 Bison ..... E05B 69/006 211/7
5,628,413 A * 5/1997 Lu ..... A47F 5/02 211/13.1
5,678,811 A * 10/1997 Johnson ..... B25B 5/10 211/49.1
5,692,605 A * 12/1997 Lai ..... A45C 11/16 206/566
5,718,072 A * 2/1998 Garfinkle ..... G09F 3/204 40/606.15
5,746,074 A * 5/1998 Collins ..... A01D 34/828 70/14
5,762,184 A * 6/1998 Greiner ..... A47F 5/10 206/6.1
5,769,244 A * 6/1998 Wyatt ..... A47F 7/142 211/40
5,782,025 A * 7/1998 Yoder ..... F41C 9/02 42/1.09
5,796,337 A * 8/1998 Wachsman ..... G08B 13/1463 340/568.8
5,823,358 A * 10/1998 Leyden ..... A47F 5/0861 211/124
5,899,101 A * 5/1999 West ..... B60R 25/00 70/226
5,913,433 A * 6/1999 Belokin ..... A47F 5/0043 211/75
5,975,318 A * 11/1999 Jay ..... A47F 5/101 211/150
5,988,405 A * 11/1999 Weisenburger ..... A47F 7/146 211/40
6,053,016 A * 4/2000 Young ..... E05B 73/0082 70/159
6,142,254 A * 11/2000 Claybaugh ..... H04R 1/023 181/141
6,158,578 A * 12/2000 Greiner ..... A47F 5/10 206/6.1
6,168,032 B1 * 1/2001 Merl ..... A47B 96/061 108/108
6,206,208 B1 * 3/2001 Dennig ..... A47F 7/02 211/85.2
6,216,375 B1 * 4/2001 Griffin ..... G09F 7/10 40/618
6,241,105 B1 * 6/2001 Pomper ..... A47F 5/04 206/6.1
6,321,871 B1 * 11/2001 Russell ..... E04B 1/86 181/290
6,361,130 B1 * 3/2002 Kardy ..... A47B 81/00 211/85.2
6,375,018 B1 * 4/2002 Clement ..... A47F 7/02 211/85.2
6,543,166 B1 * 4/2003 Griffin ..... G09F 7/02 40/618
6,585,118 B2 * 7/2003 Kellogg ..... A47F 3/001 211/13.1
6,665,969 B1 * 12/2003 Conway ..... G09F 3/204 40/605
6,796,064 B2 * 9/2004 Gibson ..... G09F 7/22 40/606.15
7,104,094 B2 * 9/2006 Zadak ..... A47F 5/0861 211/4
7,143,534 B2 * 12/2006 Kaminski ..... G09F 7/22 40/606.15
7,178,670 B2 * 2/2007 Chen ..... B25H 3/04 206/376
7,191,905 B2 * 3/2007 Robertson ..... A47F 3/0486 211/75
7,198,835 B2 * 4/2007 Anderson ..... A47H 23/04 428/100
7,207,439 B2 * 4/2007 Casella ..... A45C 9/00 206/457
D563,694 S * 3/2008 Mitchell ..... D6/682.6
7,389,868 B2 * 6/2008 Lewand ..... A45C 11/16 206/495
D581,987 S * 12/2008 Maier-Hunke ..... D20/42
8,056,740 B2 * 11/2011 Weshler ..... A47F 7/024 211/119.003
8,087,522 B2 * 1/2012 Stafford ..... A47F 5/0025 108/108
8,141,721 B2 * 3/2012 Harris-Bowman ..... A47F 7/03 206/6.1
8,266,933 B2 * 9/2012 Bishir, Jr. ..... E05B 67/24 124/86
8,387,808 B2 * 3/2013 Radowski ..... A47G 25/1464 211/123
8,434,388 B2 * 5/2013 Chaffins ..... B67B 7/16 81/3.08
8,561,953 B2 * 10/2013 Waggoner ..... A47B 96/1408 248/220.21
8,650,786 B2 * 2/2014 Trigg ..... G09F 3/00 40/1.5
9,447,630 B1 * 9/2016 Nguyen ..... E06B 7/28
9,622,596 B2 * 4/2017 Trainor-Smith ..... A47F 7/022
9,774,135 B2 * 9/2017 Laine ..... H01R 13/6205
2002/0030025 A1 * 3/2002 Sipe ..... A47B 81/00 211/4
2002/0060194 A1 * 5/2002 Reiser ..... A63C 11/028 211/4
2002/0113030 A1 * 8/2002 Belisle ..... A47B 81/005 211/85.7
2007/0125137 A1 * 6/2007 Galant ..... E05B 67/383 70/58

(56) References Cited

U.S. PATENT DOCUMENTS

| | | | | |
|---|---|---|---|---|
| 2011/0114579 | A1* | 5/2011 | Breeden | A47F 1/12<br>211/59.2 |
| 2013/0168342 | A1* | 7/2013 | Yatscoff | A47F 7/02<br>211/85.2 |
| 2015/0257551 | A1* | 9/2015 | Trainor-Smith | A47F 7/02<br>211/85.2 |

* cited by examiner

JEWELRY DISPLAY CASE

BACKGROUND

The standard necklace display currently in use in the market is a T-shaped bar attached perpendicularly to a base at the bottom. The bar at the top of the T allows necklaces, bracelets, etc. to be hung and displayed for a consumer to easily view. However, the standard T-bar provides no way to, for example, keep the hanging necklaces in place, deter theft, or allow for necklace pendants to be displayed at varying heights relative to the base of the Hold bar. The standard T-bar also results in necklaces and their pendants facing the customer sideways when the T-bar is viewed from either the front or the back making viewing by the customer difficult. This also makes it necessary for the customer to manually manipulate the necklace on the T-bar to properly view the necklace. This routine need for the customer to handle the necklace paired with the relative ease by which the necklaces can be removed from the T-bar results in an increased theft concern as detecting a potential theft attempt is more difficult when manual touching and manipulation of the necklace is a regular action of even honest customers.

FIG. 8 is a prior art embodiment of the standard T-bar design which is widely used in the industry. Jewelry displayed in this manner are not secured to the T-bar and are displayed with their sides facing the front, i.e., towards the customer. This forces customers to have to manually manipulate each necklace to see the front face of it, e.g. the attached pendant, and also provides for an increased theft risk as act of grabbing the necklace is a typical behavior of all customers and does not raise suspicion by an attendant. Furthermore, theft is easy and simple to achieve by simply sliding the necklace off the end of the T-bar.

There is therefore a need for a jewelry display device which securely displays jewelry at varying heights in such a way that the jewelry faces outward when the hold bar is positioned horizontal to the eye line of the customer and also prevents theft while still allowing the customer to handle and interact with the jewelry.

SUMMARY OF INVENTION

The invention of the current application is directed to a jewelry display device which securely displays jewelry at optionally varying heights in such a way that the jewelry optionally face outward when the hold bar is positioned horizontal to the eye line of the customer and also optionally prevent theft while optionally still allowing the customer to handle and interact with the jewelry.

The jewelry display device of the current invention includes a hold bar.

For the purposes of this invention a hold bar comprises at least one top portion which is made up of or includes a holder. The hold bar also optionally includes a shaft portion which is attached to the top portion and optionally attached to a base.

In the preferred embodiment, the hold bar is T-shaped. In other embodiments the hold bar is not a T-shape. The holder allows for any geometric shape for the hold bar as the holder functions to secure the necklaces. Optional geometric shapes for the hold bar are, for example, Y-shaped, zig-zag, a circle, a triangle, a square, etc., i.e., any regular polygon and any irregular polygon. In some embodiments, the shaft and top portion can be combined into a single structure. In such embodiments the holder occupies at least part of the shaft and top portion combination.

In some embodiments the top portion of the hold bar is parallel to the base and perpendicular to the shaft of the hold bar.

For the purposes of this invention a holder is defined as an additional structure on at least part of the hold bar which is capable of allowing at least one piece of jewelry, for example, a necklace or bracelet, to be secured to the hold bar structure without requiring the jewelry to be hung over the entirety of the body of the hold bar structure through the center thereby providing for the option to display the jewelry in a front and back orientation to the customer when the hold bar top portion is horizontal to the customer.

In the preferred embodiments, the holder is an upward-facing sawtooth. In the preferred embodiments, the holder allows a plurality of jewelry to be secured to the hold bar structure.

In the preferred embodiments, the jewelry display device of the current invention includes a security bar which is provided in a position parallel to the bar. In some embodiments the security bar is a C-channeled security bar. The C-channeled security bar is a security bar that is in the shape of a C which fits over the holder. The security bar is capable of being locked and unlocked. The security bar can be locked and unlocked by any method including a pad lock, magnetism, deadbolt, cam lock, etc. When locked, the security bar is suitable for preventing removal of jewelry from the hold bar by physically preventing the jewelry from being removed from the bar. In some embodiments, the security bar, when locked, is positioned so that it covers the top of the upward-facing sawtooth holder. As such, jewelry hanging from the sawtooth holder is prevented from being removed. In other embodiments, the hold bar and security bar, when locked, is positioned so as to create a four sided space which is interlocked with the jewelry on display like interlocking rings of a chain.

In some embodiments, the security bar is locked by use of a padlock that locks the security bar and a lock receiver portion in the top portion hold bar. In some embodiments the security bar portion also includes a lock receiver portion. The lock receiver portion can be anywhere along the top portion of the hold bar or the security bar as long as the location allows for a lock to secure the security bar to the top portion hold bar.

One purpose of the holder is, for example, when the holder is of a sawtooth configuration, to allow for the option to hang jewelry around each tooth. This allows, for example, for necklaces and their pendants to be orientated forward when the hold bar is viewed from the front or the back by a customer and allows for the height of the necklace pendants relative to the base of the hold bar to be adjusted. This allows for much more versatility over a tradition T-bar.

In some embodiments, the security bar is placed parallel over the top of the holder. A centered hole in the security bar lines up with a top-centered hole on the holder, allowing for a lock to lock the two together. The security bar thus acts to prevent theft and also prevents necklaces from slipping off of the holder and/or hold bar.

In some embodiments, the detachable security bar is attached to the holder via a hinge. In some embodiments, the security bar slides over the holder. In some embodiments, the security bar is a flat bar and placed into a suitable position, while still retaining its original function.

In some embodiments the holder uses different geometric shapes to secure the jewelry to the bar. The holder can be made up of any shape which allows jewelry to be secured to the bar structure without requiring the jewelry to be draped over the entirety of the body of the hold bar structure thereby providing for the option to display the jewelry in a front and back orientation to the customer when the top portion of the hold bar is horizontal to the customer.

In some embodiments, the hold bar is made of a high-friction material where the high-friction material functions as the holder. Such a holder material is suitable for allowing a jewelry to be secured to the bar structure without requiring the jewelry to be draped over the entirety of the body of the hold bar structure thereby providing for the option to display the jewelry in a front and back orientation to the customer when the top portion of the hold bar is horizontal to the customer.

In some embodiments, the security bar includes an internal locking mechanism, rather than one that relies on an external lock, e.g., an independent padlock.

In some embodiments, the device also includes a banner portion. The banner portion is positioned on the front of the device and acts to hide the holder portion and security bar elements from a person viewing the device from the front. The banner portion can also be used to display writing, pictures or advertisements. In some embodiments the banner portion includes a video display which is optionally a touch screen.

In some embodiments, the top portion of the hold bar is at least partially attached to the shaft portion of the hold bar via a bracket. In some embodiments, the top portion of the hold bar is a mechanical connection to the banner portion. In some embodiments, the top portion of the hold bar and the banner are positioned on opposite sides of the shaft portion. In some embodiments, the top portion of the hold bar is in direct mechanical connection to both the banner portion and the shaft portion.

In some embodiments the jewelry display device comprises at least one hold bar comprising;

at least one holder wherein said holder is suitable for holding jewelry and preventing substantial lateral movement of said jewelry at the hold point, and wherein said holder is suitable for displaying said jewelry in a position such that the necklace faces outward when the hold bar is positioned horizontal to the eye line of the customer.

The hold point is the point of contact between the jewelry and the holder. In some embodiments the holder allows for no lateral movement at the hold point. In some embodiments, the holder allows for lateral movement at points other than the hold point, meaning the necklace can be swung and manipulated 360 degrees.

In some embodiments the jewelry display device additionally comprises, at least one security bar wherein said at least one security bar is in removable connection with said holder, wherein said security bar is capable of being locked to the hold bar and wherein said security bar, when locked to the hold bar, is suitable for preventing the removal of said jewelry from said holder.

In some embodiments the jewelry display device the at least one security bar is attached to said at least one hold bar by at least one hinge.

In some embodiments the jewelry display device the at least one security bar and at least one hold bar included at least one lock receiver wherein said least one lock receivers on said least one security bar and at least one hold bar so as to allow a lock to pass through both lock receiver portions and be locked and unlocked.

In some embodiments the jewelry display device the hold bar includes a shaft.

In some embodiments the jewelry display device the holder is an upward-facing sawtooth.

In some embodiments the jewelry display device the security bar is a C-channeled security bar.

In some embodiments the jewelry display device the shaft is adjustable in height.

In some embodiments the jewelry display device the shaft is connected to said top portion by a bracket which is positioned at the top of the shaft.

In some embodiments the jewelry display device additionally comprises a base which is connected to said shaft and suitable for supporting the device.

In some embodiments the jewelry display device additionally comprises a front plate.

In some embodiments the jewelry display device the front plate completely hides the top portion of the hold bar when viewed by an observer directly from the front of the device.

In some embodiments the jewelry display device additionally comprises support members which directly connect to and attach the top portion to the front plate.

In some embodiments the jewelry display device the support members penetrate one of or both of the front plate and top portion.

In some embodiments the jewelry display device is used in a method for displaying jewelry comprising hanging said jewelry from the device.

DETAILED DESCRIPTION THE DRAWINGS

Figure 1:
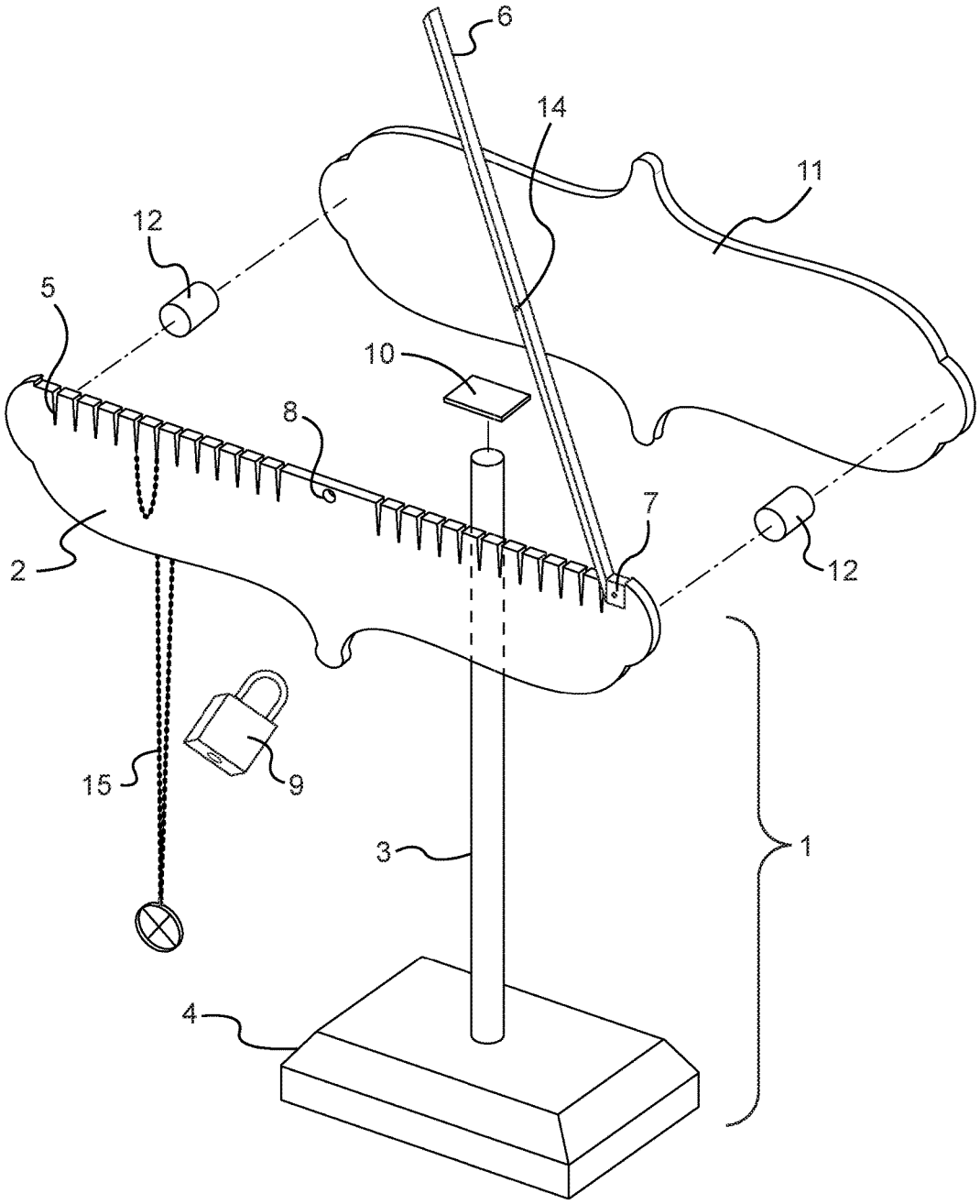
FIG. 1 is an exploded front perspective view showing the components of an embodiment of the invention.

FIG. 1 shows exploded front perspective view of an embodiment of the invention. This embodiment includes a hold bar (1). The hold bar (1) has as a top portion (2), a shaft (3) and a base (4). The top portion (2) includes a holder (5) which is depicted as an upward-facing sawtooth in the depicted embodiment. In some embodiments there may be a plurality of holders or the same or different designs. The holder (5) also allows for the height of the pendants on the necklaces to be adjusted relative to the base of the hold bar (1) and keeps the necklaces in a fixed place on the holder. A security bar (6), which is shown as a C-channeled security bar, is attached to the top portion (2) of the hold bar (1) via a hinge (7). The security bar includes a lock receiver (14) for lock (9). The top portion (2) also includes a lock receiver (8) for lock (9).

FIG. 1 also shows, bracket (10) which is attached to the top of the shaft (3) and functions to attach the top portion (2) and optionally the front plate (11) to the shaft (3). Support members (12) are also shown and attached the top portion (2) to front plate (11). In some embodiments, Support members (12) penetrate one of or both of the front plate (11) and top portion (2).

FIG. 1 shows jewelry, a necklace (15) hanging from holder (5) with pendent portion facing out toward the front of the device.

Figure 2:
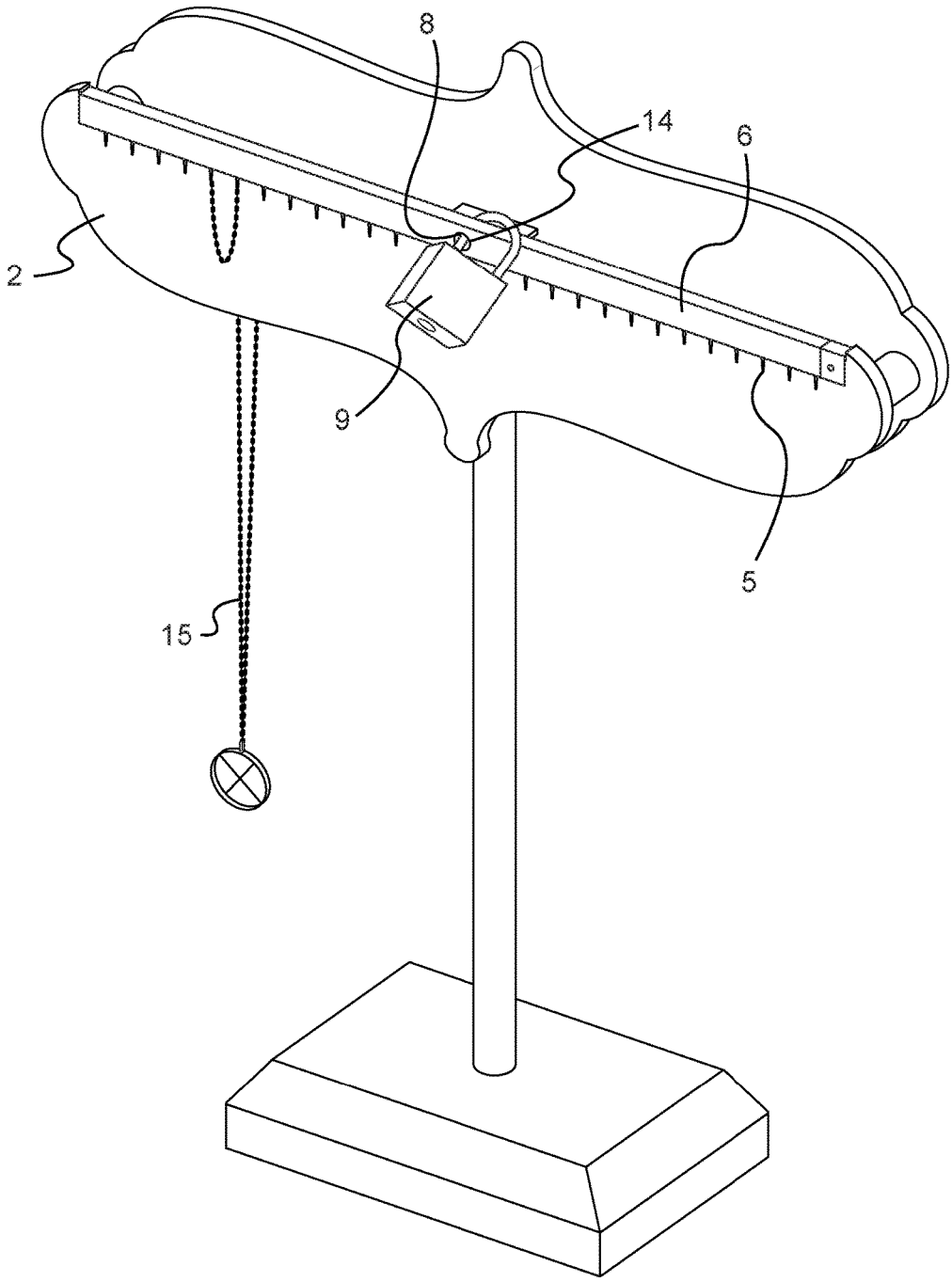
FIG. 2 is a back perspective view showing an embodiment of the invention in a locked configuration.

FIG. 2 shows a back perspective view of an embodiment of the invention in a locked configuration. The security bar (6) is positioned over the holder (5) in a manner such that the necklace (15) is prevented from being removed from the holder (5) but also remains accessible to see and touch by a customer.

FIG. 2 also shows lock (9) locked in to the lock receivers (8) and (14) preventing the security bar (6) from being lifted off the top portion (2).

Figure 3:
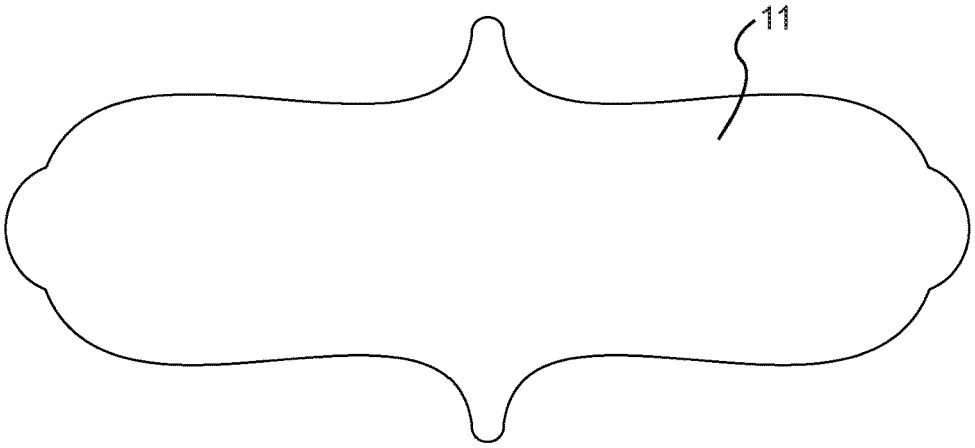
FIG. 3 shows the front plate of an embodiment of the invention.

FIG. 3 shows the front plate (11) from a front view. The front plate (11) optionally contains graphics, writing, or a display screen. The front plate (11) is optionally made of plastic, metal, wood, or some other solid material. In the preferred embodiment the front plate also functions to hide the many of the other elements of the invention from the view of a customer.

Figure 4:
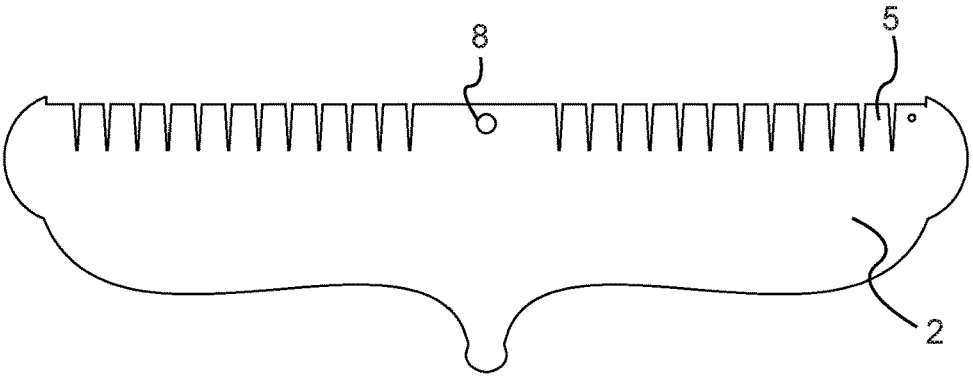
FIG. 4 shows the top portion of a hold bar with an upward-facing sawtooth holder.

FIG. 4 shows the top portion (2) including the holder (5). The top portion also includes a lock receiver (8) in the center. The top portion (2) and holder (5) is optionally made of plastic, metal, wood, or some other solid material. The top portion (2) and holder (5) are optional made of the same material or different materials.

Figure 5:
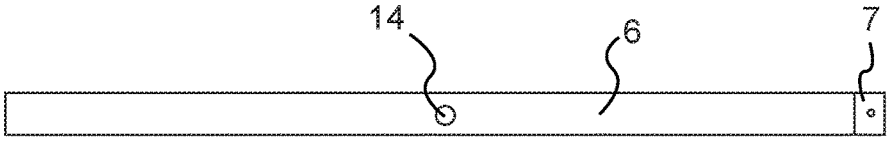
FIG. 5 shows a C-channeled security bar with a center lock receiver and a side hinge.

FIG. 5 shows the security bar (6) with hinge (7) and a lock receiver (14) in the center. The security bar (6) is optionally made of plastic, metal, wood, or some other solid material. In the preferred embodiment the security bar is made of a material that is at least as strong at the top portion (2). For example, the top portion (2) is plastic, and the security bar (6) is metal. In the preferred embodiment the security bar (6) is the same length or longer that the holder (5). In some embodiments the security bar covers only a portion of the holder (5). The hinge (7) may be on either side of the security bar (6).

Figure 6:
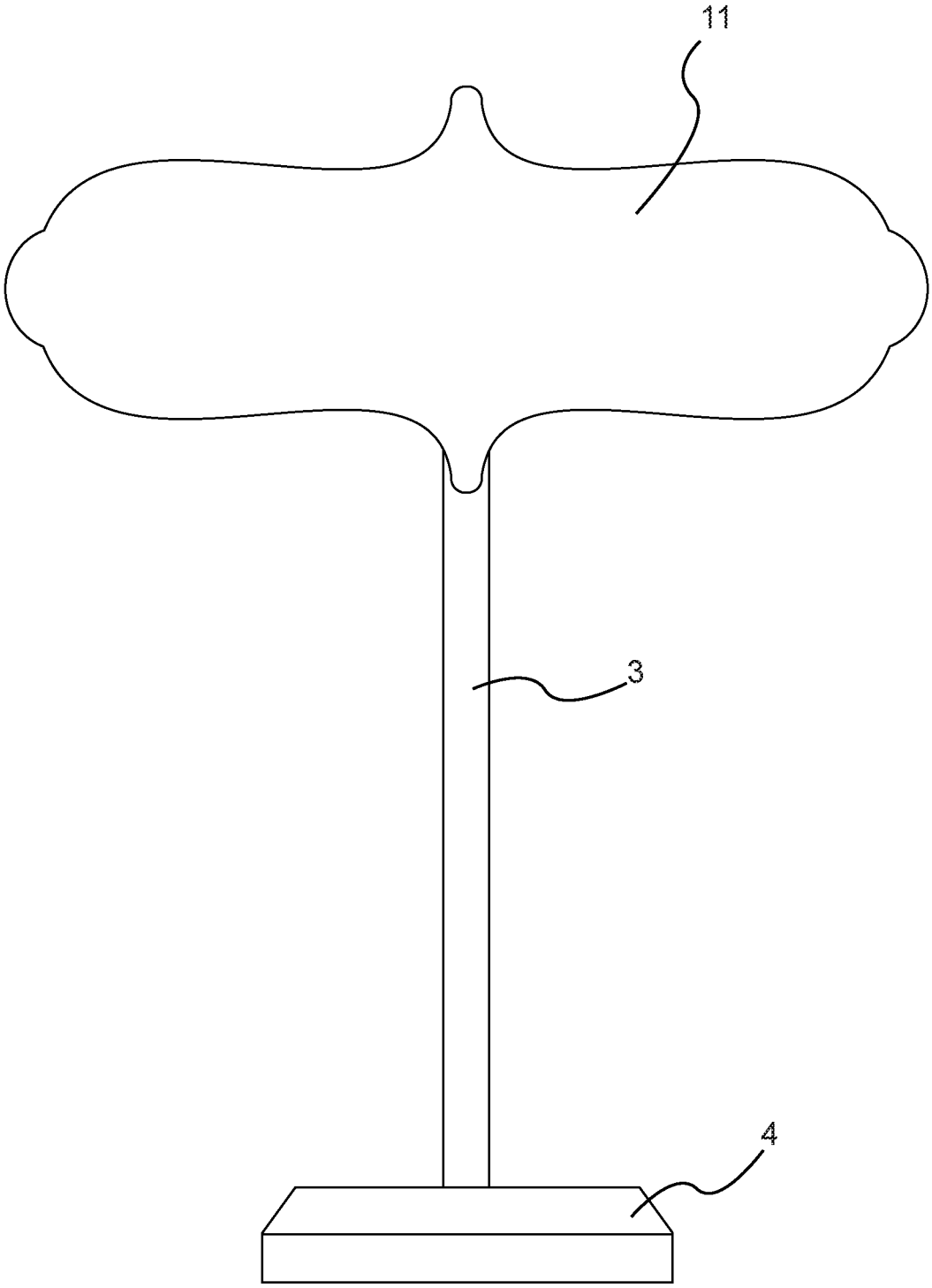
FIG. 6 shows a front view of an embodiment of the invention.

FIG. 6 shows a front view where the front plate (11) hides all but the shaft (3) and the base (4) from view. The base (4) is a sufficient size to support the structure and the shaft (3) can be any length sufficient to bring the top portion (2) to a desired height. In some embodiments the shaft (3) is adjustable in length.

Figure 7:
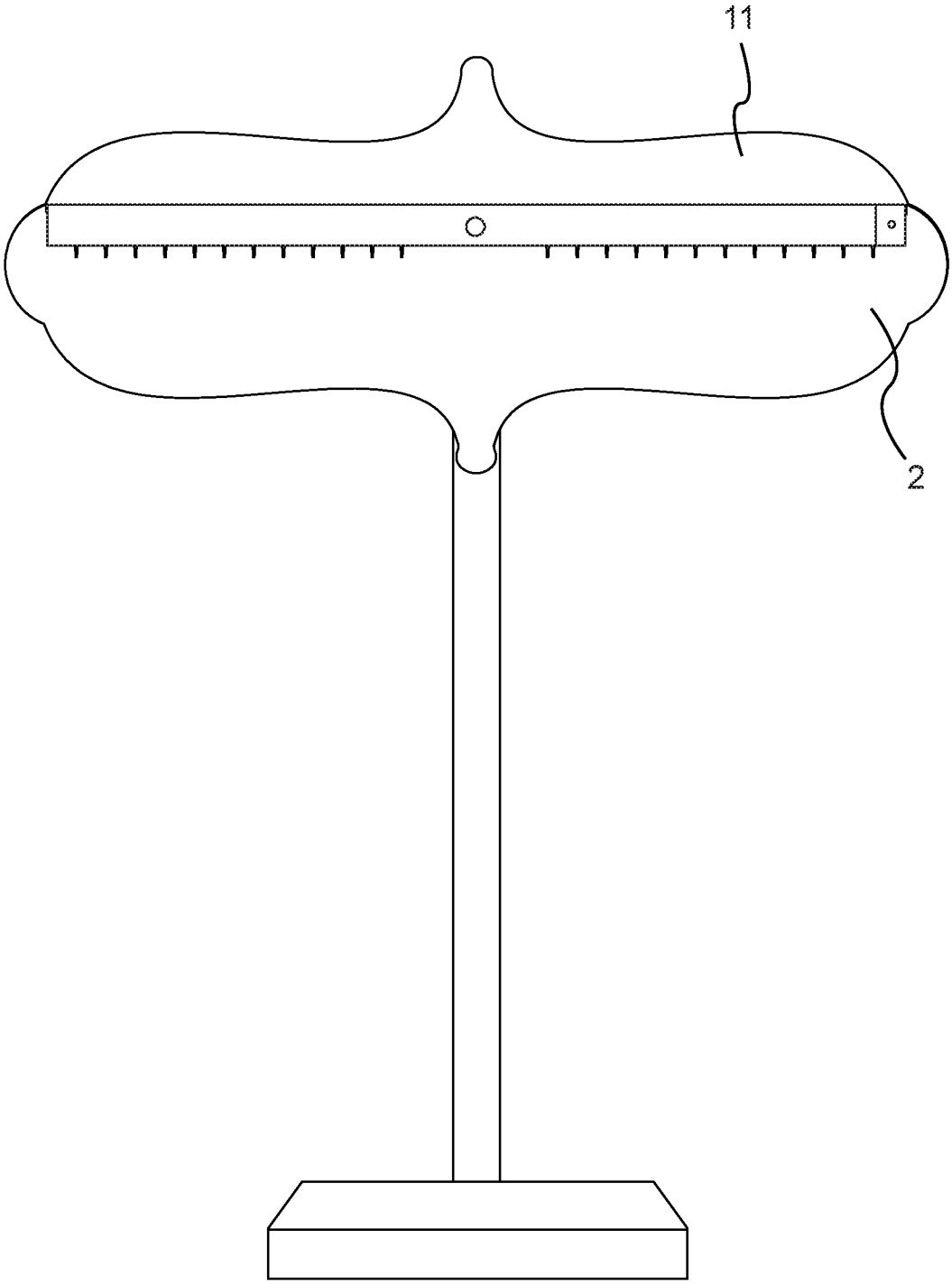
FIG. 7 shows a back view of an embodiment of the invention.
Figure 8:
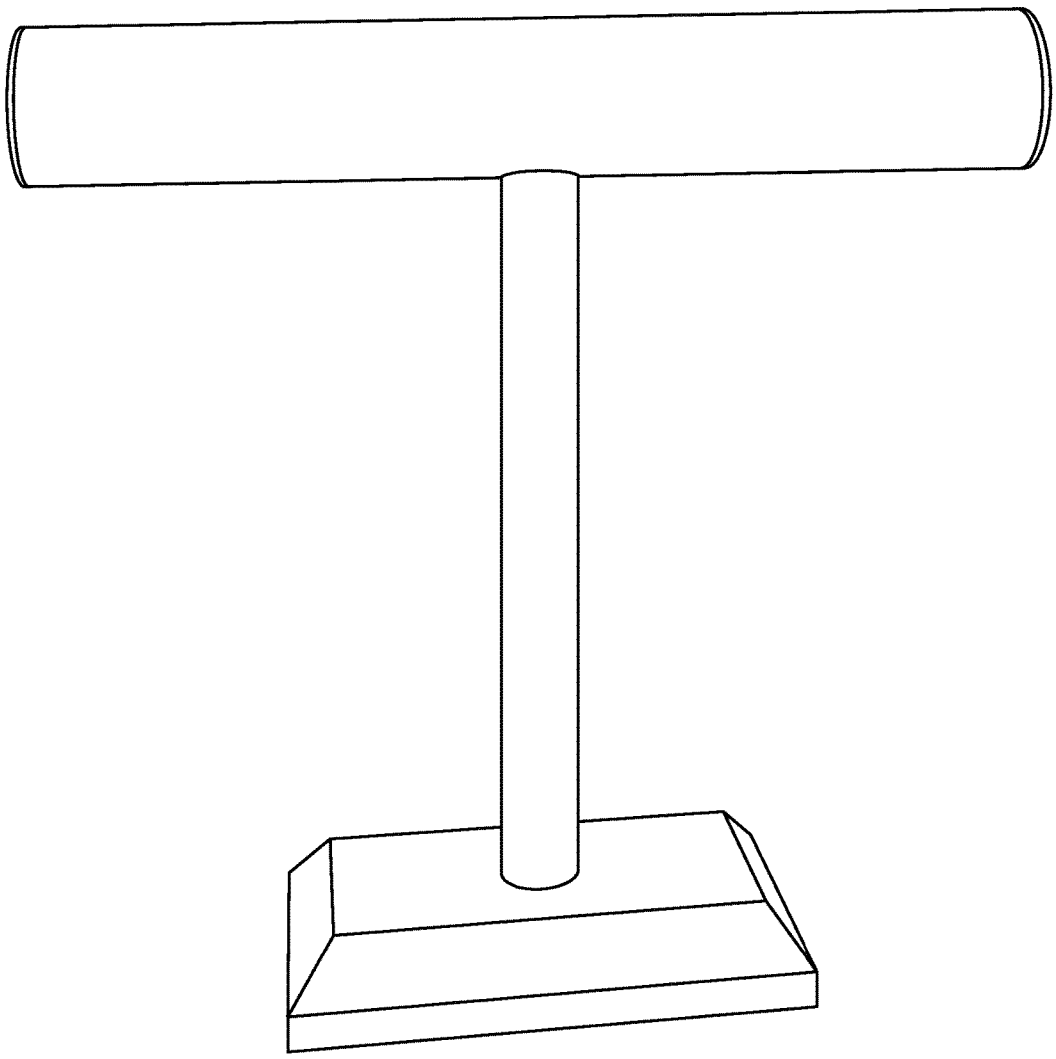
FIG. 8 PRIOR ART
FIG. 8 is a prior art embodiment.

FIG. 7 shows a back view of the embodiment shown in FIG. 6. In the shown embodiment, the outline shape of the top portion (2) perfectly matches the outline shape of the front plate (11). This allows the top portion (2) to be completely hidden from a front viewing observer while maximizing the available surface area for the top portion (2). Without further elaboration, it is believed that one skilled in the art can, using the preceding description, utilize the present invention to its fullest extent. The preceding preferred specific embodiments are, therefore, to be construed as merely illustrative, and not limitative of the remainder of the disclosure in any way whatsoever.

From the foregoing description, one skilled in the art can easily ascertain the essential characteristics of this invention and, without departing from the spirit and scope thereof, can make various changes and modifications of the invention to adapt it to various usages and conditions.

What is claimed is:

1. A jewelry display device comprising:

a planar front plate;

a planar rear plate positioned behind and in parallel with the front plate, wherein the rear plate has a plurality of holders, wherein each holder is an upward-facing sawtooth, wherein grooves surround each sawtooth; wherein each sawtooth is configured for holding jewelry such that said jewelry is positioned around a corresponding upward-facing sawtooth from said plurality of holders of said rear plate and nested within corresponding grooves of said grooves; and wherein each holder is configured to prevent substantial lateral movement of said jewelry within said corresponding grooves, a security bar, wherein said security bar is attached to said rear plate by at least one hinge, wherein said security bar is in removable connection with said holders, wherein said security bar is configured to be locked to the rear plate; and wherein said security bar, when locked to the rear plate is configured to prevent the removal of said jewelry from said holders, and wherein said security bar has a bottom channel, wherein the bottom channel of the security bar is configured to receive a top portion of the rear plate to substantially cover the holders and secure said jewelry in the grooves;

a pad lock;

wherein the security bar and the rear plate each include at least one lock receiver hole formed therein respectively, wherein the lock receiver holes are configured to allow the pad lock to pass therethrough respectively to lock the security bar to the rear plate and unlock the security bar from the rear plate, wherein said front plate is attached to the rear plate by support members which are directly connected to said front plate and said rear plate and wherein said support members penetrate one of or both of the front plate and the rear plate, wherein the front plate is configured to completely hide the rear plate when viewed by an observer positioned directly from the front of the device;

a base, and an upright shaft connected to and extending upwardly from said base; wherein said upright shaft is configured to support said rear plate and said front plate above the base, wherein an upper portion of said upright shaft is positioned between said rear plate and said front plate.

2. The jewelry display device of claim 1, wherein said shaft is connected to said rear plate by a bracket which is positioned at the upper portion of the shaft.

3. A jewelry display device consisting of:

a planar front plate;

a planar rear plate positioned behind and in parallel with the front plate, wherein the rear plate has a plurality of holders, wherein each holder is an upward-facing sawtooth, wherein grooves surround each sawtooth; wherein each sawtooth is configured for holding jewelry such that said jewelry is positioned around a corresponding upward-facing sawtooth from said plurality of holders of said rear plate and nested within corresponding grooves of said grooves; and wherein each holder is configured to prevent substantial lateral movement of said jewelry within said corresponding grooves, a security bar, wherein said security bar is attached to said rear plate by at least one hinge, wherein said security bar is in removable connection with said holders, wherein said security bar is configured to be locked to the rear plate; and wherein said security bar, when locked to the rear plate is configured to prevent the removal of said jewelry from said holders, and wherein said security bar has a bottom channel, wherein the bottom channel of the security bar is configured to receive a top portion of the rear plate to substantially cover the holders and secure said jewelry in the grooves;

a pad lock;

wherein the security bar and the rear plate each include at least one lock receiver hole formed therein respectively, wherein the lock receiver holes are configured to allow the pad lock to pass therethrough respectively to lock the security bar to the rear plate and unlock the security bar from the rear plate, wherein said front plate is attached to the rear plate by support members which are directly connected to said front plate and said rear plate and wherein said support members penetrate one of or both of the front plate and the rear plate, wherein the front plate is configured to completely hide the rear plate when viewed by an observer positioned directly from the front of the device;

a base, and an upright shaft connected to and extending upwardly from said base; wherein said upright shaft is configured to support said rear plate and said front plate above the base, wherein an upper portion of said upright shaft is positioned between said rear plate and said front plate.

4. A jewelry display device consisting of:

a planar front plate;

a planar rear plate positioned behind and in parallel with the front plate, wherein the rear plate has a plurality of holders, wherein each holder is an upward-facing sawtooth, wherein grooves surround each sawtooth; wherein each sawtooth is configured for holding jewelry such that said jewelry is positioned around a corresponding upward-facing sawtooth from said plurality of holders of said rear plate and nested within corresponding grooves of said grooves; and wherein each holder is configured to prevent substantial lateral movement of said jewelry within said corresponding grooves, a security bar, wherein said security bar is attached to said rear plate by at least one hinge, wherein said security bar is in removable connection with said holders, wherein said security bar is configured to be locked to the rear plate; and wherein said security bar, when locked to the rear plate is configured to prevent the removal of said jewelry from said holders, and wherein said security bar has a bottom channel, wherein the bottom channel of the security bar is configured to receive a top portion of the rear plate to substantially cover the holders and secure said jewelry in the grooves;

a pad lock;

wherein the security bar and the rear plate each include at least one lock receiver hole formed therein respectively, wherein the lock receiver holes are configured to allow the pad lock to pass therethrough respectively to lock the security bar to the rear plate and unlock the security bar from the rear plate, wherein said front plate is attached to the rear plate by support members which are directly connected to said front plate and said rear plate and wherein said support members penetrate one of or both of the front plate and the rear plate, wherein the front plate is configured to completely hide the rear plate when viewed by an observer positioned directly from the front of the device;

a base, and an upright shaft connected to and extending upwardly from said base;

wherein said upright shaft is connected to said rear plate by a bracket which is positioned at the upper portion of the upright shaft, wherein said upright shaft is configured to support said rear plate and said front plate above the base, wherein an upper portion of said upright shaft is positioned between said rear plate and said front plate.

* * * * *